US007389910B2

(12) United States Patent
Spencer

(10) Patent No.: US 7,389,910 B2
(45) Date of Patent: Jun. 24, 2008

(54) COLLECTION CANISTER SYSTEM FOR CHARITIES

(76) Inventor: Wayne Spencer, 16010 Hampton Village Dr., Tampa, FL (US) 33618

( * ) Notice: Subject to any disclaimer, the term of this patent is extended or adjusted under 35 U.S.C. 154(b) by 0 days.

(21) Appl. No.: 11/318,220

(22) Filed: Dec. 23, 2005

(65) Prior Publication Data

US 2006/0144917 A1 Jul. 6, 2006

Related U.S. Application Data

(63) Continuation-in-part of application No. 11/028,367, filed on Jan. 3, 2005, now Pat. No. 7,185,802.

(51) Int. Cl.
*A47G 29/00* (2006.01)

(52) U.S. Cl. ..... 232/4 R; 232/1 D; 232/1 E; 232/44; 220/478; 109/52

(58) Field of Classification Search ..... 232/4 R, 232/1 E, 1 D, 43.1, 19, 44; 220/476, 478, 220/480, 481, 810; 109/50, 52, 66; 40/661–663, 40/673

See application file for complete search history.

(56) References Cited

U.S. PATENT DOCUMENTS 471,918 A * 3/1892 Van Pelt ..... 232/28
937,503 A * 10/1909 Asch ..... 70/159
1,530,908 A * 3/1925 Nutry ..... 232/4 R
2,507,785 A * 5/1950 Hartman ..... 232/19
2,754,991 A * 7/1956 Hagerty et al. ..... 220/481
2,880,864 A * 4/1959 Russo ..... 206/364
3,983,976 A * 10/1976 Taylor ..... 190/18 R
4,671,455 A * 6/1987 Stockman ..... 232/1 D
5,800,027 A * 9/1998 Dunn ..... 312/138.1
5,870,969 A * 2/1999 Boyce ..... 119/61.3
5,947,322 A * 9/1999 Ho ..... 220/477
6,540,601 B2 * 4/2003 Nottingham et al. ..... 453/3
6,742,294 B1 * 6/2004 Fossum ..... 40/611.1
6,920,835 B1 * 7/2005 Johnson ..... 109/68

* cited by examiner

*Primary Examiner*—William L. Miller
(74) *Attorney, Agent, or Firm*—Edward P. Dutkiewicz

(57) ABSTRACT

A collection canister system having a front panel and a rear panel. The rear panel has top and bottom edges and side edges there between and forwardly extending sides. The front panel has top and bottom edges and side edges there between and rearwardly extending sides rotatably coupled to the sides of the rear panel. An opening is adjacent to the top of the front and rear panels for deposition of charitable contributions. A plurality of locks facilitate the securement of the contributions within the canister.

10 Claims, 13 Drawing Sheets

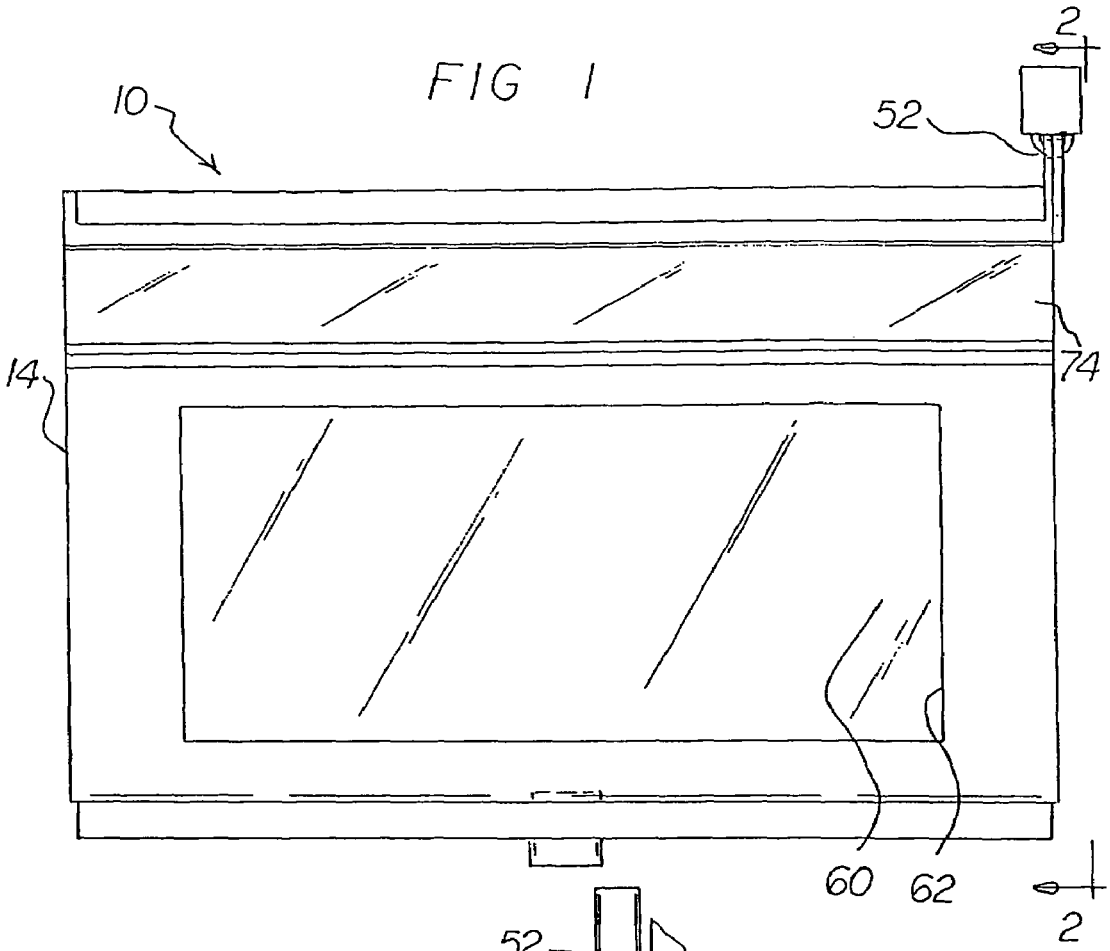
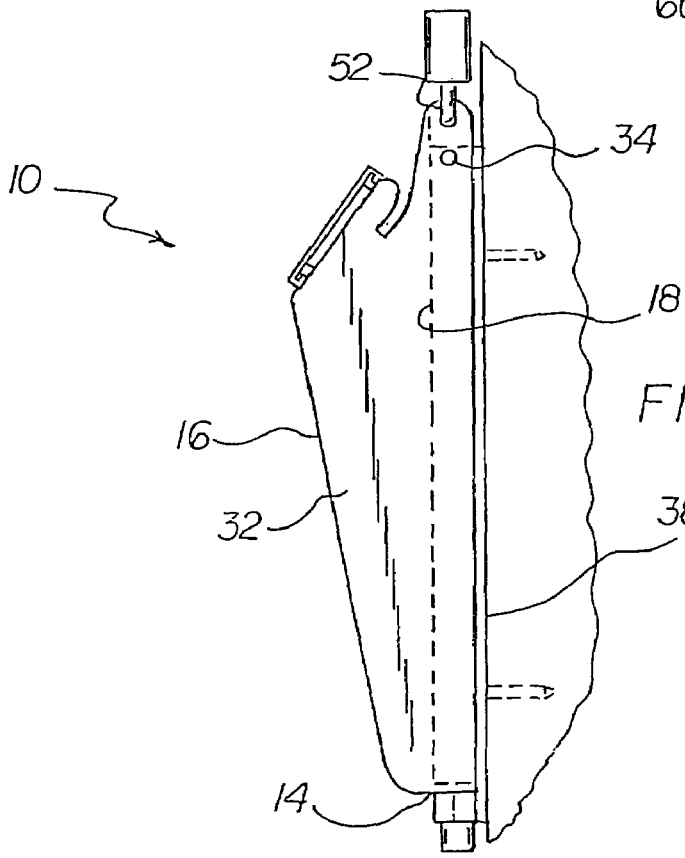
FIG 2

FIG 6
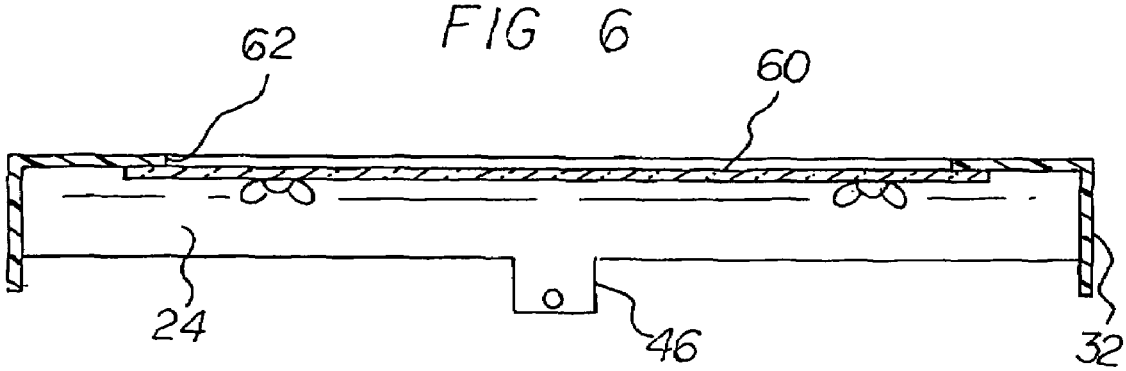
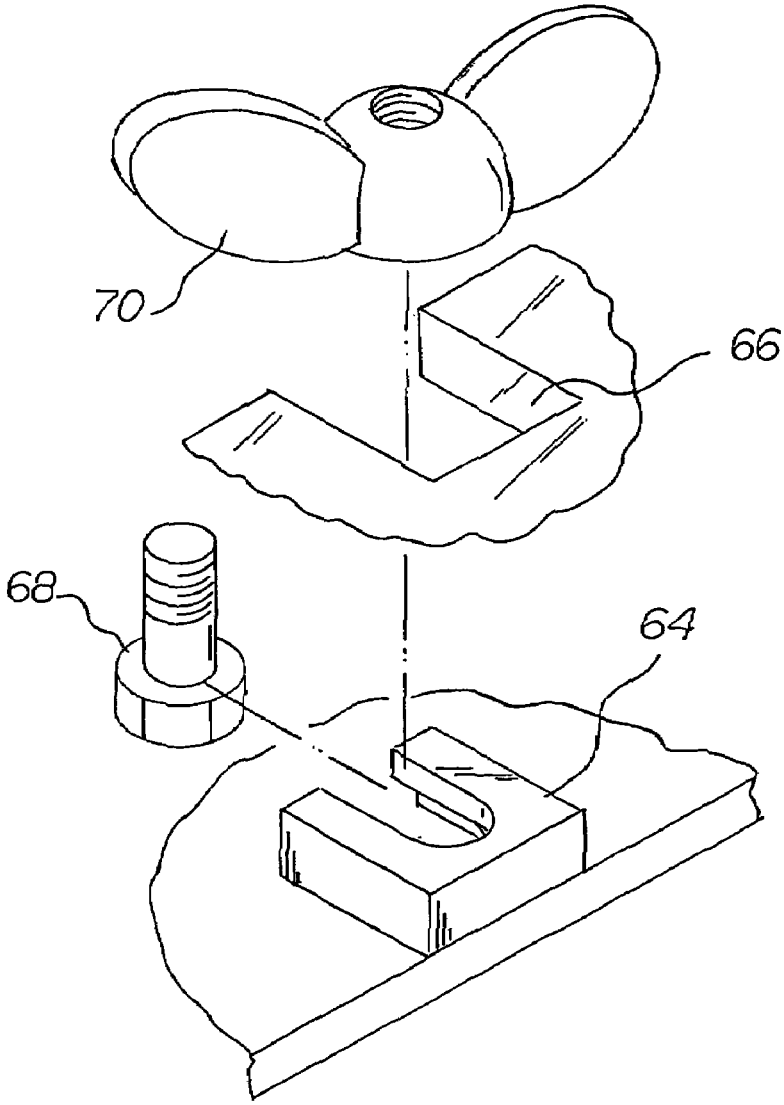
FIG 7

COLLECTION CANISTER SYSTEM FOR CHARITIES

RELATED APPLICATION

This application is a continuation-in-part application of patent application, Ser. No. 11/028,367, filed on Jan. 3, 2005, and this application seeks priority under the parent application, issued as U.S. Pat. No. 7,185,802.

BACKGROUND OF THE INVENTION

1. Field of the Invention

The present invention relates to a collection canister system for charities and more particularly pertains to for ensuring the secure and convenient retention of donations to charities.

2. Description of the Prior Art

The use of canisters and collection systems of known designs and configurations is known in the prior art. More specifically, canisters and collection systems of known designs and configurations previously devised and utilized for the purpose of securing and retaining donations through known methods and configurations are known to consist basically of familiar, expected, and obvious structural configurations, notwithstanding the myriad of designs encompassed by the crowded prior art which has been developed for the fulfillment of countless objectives and requirements.

In this respect, the collection canister system for charities according to the present invention substantially departs from the conventional concepts and designs of the prior art, and in doing so provides an apparatus primarily developed for the purpose of for collecting donations to charity and for ensuring the secure and convenient retention of such collected donations.

Therefore, it can be appreciated that there exists a continuing need for a new and improved collection canister system for charities which can be used for ensuring the secure and convenient retention of donations to charities. In this regard, the present invention substantially fulfills this need.

SUMMARY OF THE INVENTION

In view of the foregoing disadvantages inherent in the known types of collection systems of known designs and configurations now present in the prior art, the present invention provides an improved collection canister system for charities. As such, the general purpose of the present invention, which will be described subsequently in greater detail, is to provide a new and improved collection canister system for charities and method which has all the advantages of the prior art and none of the disadvantages.

To attain this, the present invention essentially comprises a horizontally positionable collection canister. The canister has a front panel and a rear panel. The rear panel has horizontal top and bottom edges. Vertical side edges are provided between the top and bottom edges. The canister has laterally displaced linear slots. The linear slots extends upwardly from the bottom edge parallel with the side edges. The rear panel also has forwardly extending sides. The real panel further has a forwardly extending bottom. An indentation is provided adjacent to the bottom edge in a central extent. The front panel has a larger lower section and a smaller upper section. The upper and lower sections form an obtuse angle. The front panel also has rearwardly extending sides. The front panel has pivot pins. The pivot pins rotatably couple the tops of the sides of the front panel with the tops of the sides of the rear panel.

An opening is provided at the top of the front and rear panels for the deposition of charitable contributions. In this manner the front panel is allowed to move forwardly to an open orientation and rearwardly to a closed orientation.

A support panel is provided. The support panel is in a rectangular configuration. The support panel has a rear surface. The rear surface is positioned against a recipient surface. The rear surface is adapted to be secured to the recipient surface with bolts. The support panel also has a front surface. The front surface has laterally spaced bars. The bars have a T-shaped configuration. The bars extend upwardly from the lower edge of the support panel. The bars are adapted to receive the slots of the canister.

Provided next is a primary locking means. The primary locking means comprises a tab. The tab has an aperture. The aperture extends rearwardly from the front panel adjacent to the lower end. A slit is provided in the indentation of the rear panel. The slit is adapted to slidably receive the tab. In this manner a primary lock may be slid through the aperture of the tab when in the closed orientation and secure the contents of the canister. Also in this manner a primary lock removed from the aperture of the tab allows movement of the front panel to an open orientation for removing the contents from the canister.

A secondary locking means is provided next. The secondary locking means includes a fixed upwardly extending projection. The fixed upwardly extending projection has a hole. The fixed upwardly extending projection is secured to one edge of the support panel adjacent to its top edge. The secondary locking means further includes a pivotable upwardly extending projection. The pivotable upwardly extending projection has a hole. The pivotable upwardly extending projection is secured to the side of the front panel adjacent to its top edge. In this manner a secondary lock may be slid through the holes when in the closed orientation and secure the canister to the support panel. Also in this manner the secondary lock may be removed from the holes of the tab and allow movement of the canister to another more secure location.

Further provided is a transparent plate. The transparent plate is in a rectangular configuration. The transparent plate has a rectangular opening in the lower portion of the front panel. The rectangular opening is smaller than the plate. Four recesses are provided in the plate. The four recesses extend rearwardly from the lower portion adjacent to the four corners of the opening. Four notches are provided in the plate. The four notches are provided adjacent to the four corners thereof. The four notches are adapted to overlie the recesses. Four bolts are provided. The four bolts have heads. The bolts are removably received by the recesses and threaded portions extending through the notches. Four wing nuts are provided. The four wing nuts are removably secure the plate to the front panel to facilitate repair and reconstruction.

Provided last is an indicia assembly. The indicia assembly includes upper and lower channels. The upper and lower channels are horizontally secured to the upper section of the front panel. The indicia assembly has a transparent generally C-shaped cover. The cover is slidable on the channels. The indicia assembly includes an indicia strip. The indicia strip is positionable on the upper section between the channels beneath the cover. In this manner the indicia may be changed relating to the charity.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved collection canister system for charities which has all of the advantages of the prior art collection systems of known designs and configurations and none of the disadvantages.

It is another object of the present invention to provide a new and improved collection canister system for charities which may be easily and efficiently manufactured and marketed.

It is further object of the present invention to provide a new and improved collection canister system for charities which is of durable and reliable constructions.

An even further object of the present invention is to provide a new and improved collection canister system for charities which is susceptible of a low cost of manufacture with regard to both materials and labor, and which accordingly is then susceptible of low prices of sale to the consuming public, thereby making such collection canister system for charities economically available to the buying public.

Even still another object of the present invention is to provide a collection canister system for charities for ensuring the secure and convenient retention of all donations to charities.

Lastly, it is an object of the present invention to provide a new and improved collection canister system having a front panel and a rear panel. The rear panel has top and bottom edges and side edges there between and forwardly extending sides. The front panel has top and bottom edges and side edges there between and rearwardly extending sides rotatably coupled to the sides of the rear panel. An opening is adjacent to the top of the front and rear panels for deposition of charitable contributions. A plurality of locks facilitate the securement of the contributions within the canister.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a collection canister system for charities.

FIG. 2 is a side elevational view of the system taken along line 2-2 of FIG. 1.

FIG. 6 is a cross sectional view taken along line 6-6 of FIG. 5.

FIG. 7 is an exploded perspective illustration taken at circle 7 of FIG. 5.

FIG. 15 is a perspective view of the rear panel of the alternate embodiment of FIG. 9.

FIG. 16 is a front view of the alternate embodiment of FIG. 9.

The same reference numerals refer to the same parts throughout the various Figures.

DESCRIPTION OF THE PREFERRED EMBODIMENT

Figure 3:
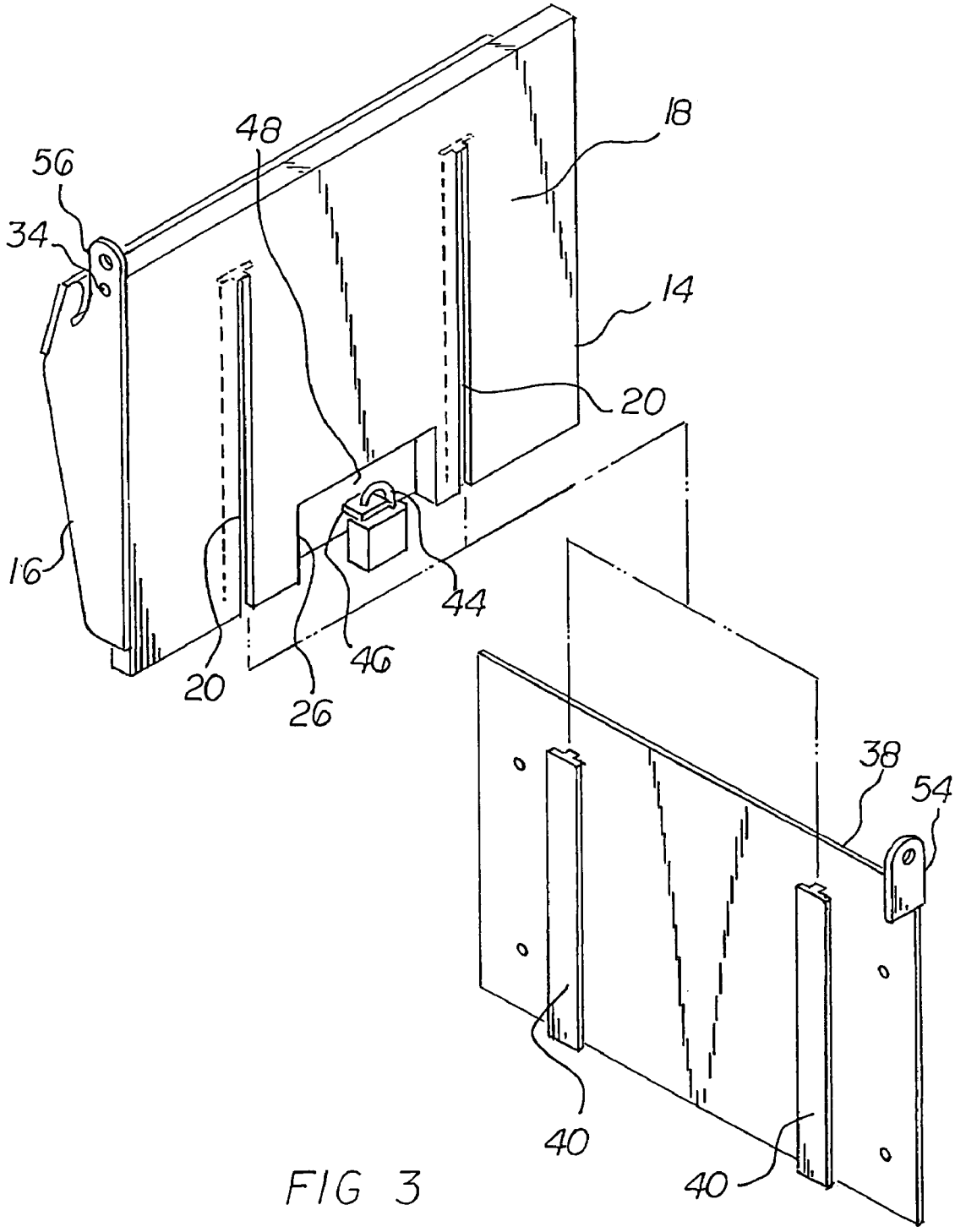
FIG. 3 is an exploded perspective illustration of the system shown in FIGS. 1 and 2.
Figure 4:
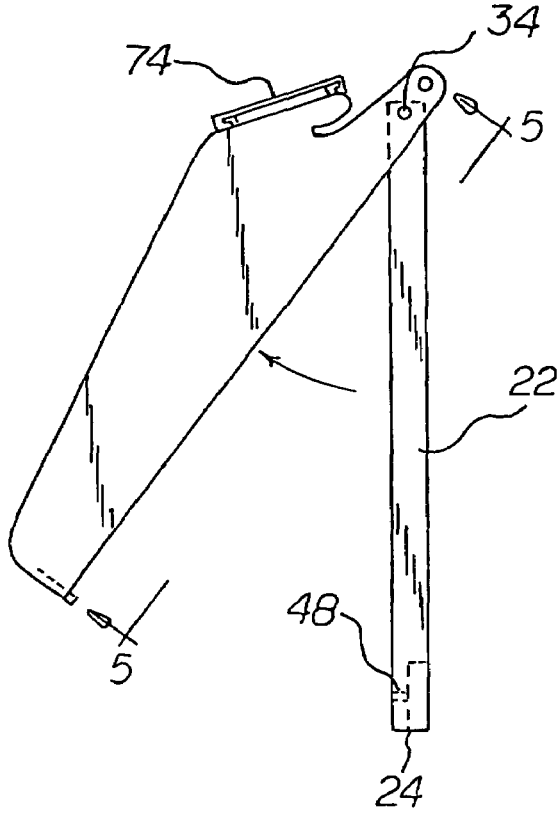
FIG. 4 is a side elevational view similar to FIG. 2 but with the front section of the canister in an open orientation.
Figure 5:
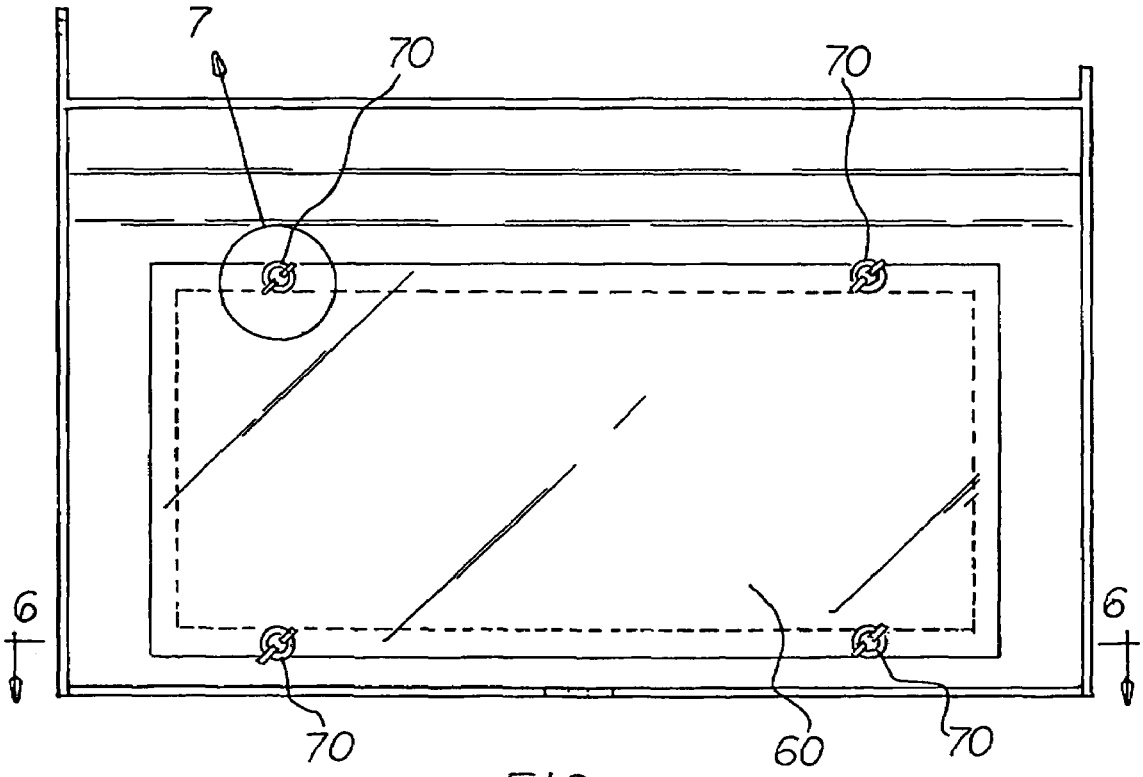
FIG. 5 is a front elevational view of the front panel of the canister taken along line 5-5 of FIG. 4.
Figure 8:
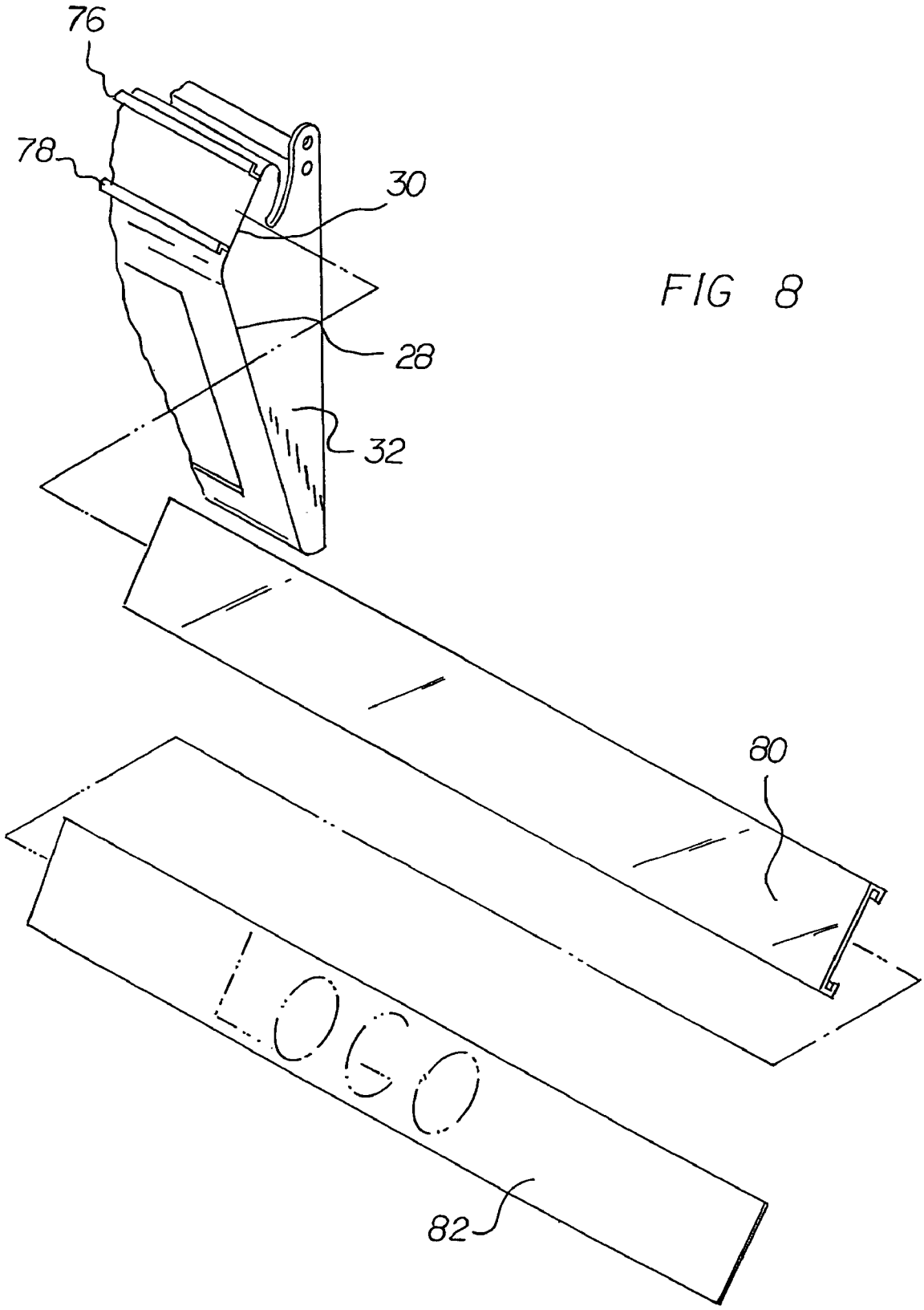
FIG. 8 is an exploded perspective illustration of the indicia assembly.

With reference now to the drawings, and in particular to FIG. 1 thereof, the preferred embodiment of the new and improved collection canister system for charities embodying the principles and concepts of the present invention and generally designated by the reference numeral 10 will be described.

The present invention, the collection canister system for charities 10 is comprised of a horizontally positionable collection canister.

First provided is a horizontally positionable collection canister 14. The canister has a front panel 16 and a rear panel 18.

The rear panel has horizontal top and bottom edges. Vertical side edges are provided between the top and bottom edges. The rear panel of the canister has a mounting means, such as laterally displaced linear slots 20. The linear slots extends upwardly from the bottom edge parallel with the side edges.

In an alternate embodiment the rear panel of the canister may not have the linear slots, but may, instead have a generally flat configuration 25.

The rear panel has forwardly extending sides 22. The real panel further has a forwardly extending bottom 24. An indentation 26 is provided adjacent to the bottom edge in a central extent.

In an alternate embodiment the rear panel may not have the indentation, but instead may have a generally flat configuration. The rear panel also has a drop deflector 27.

Figure 9:
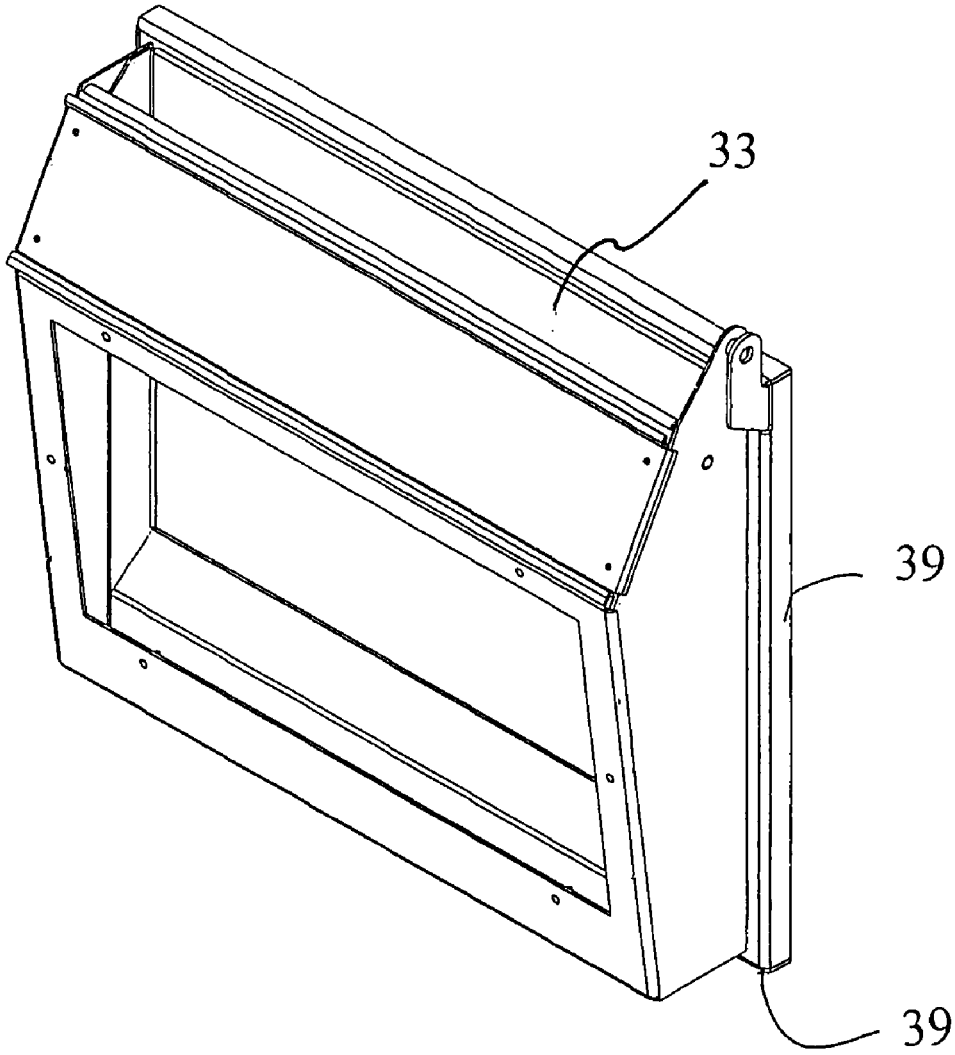
FIG. 9 is a perspective view of an alternate embodiment of the invention.
Figure 10:
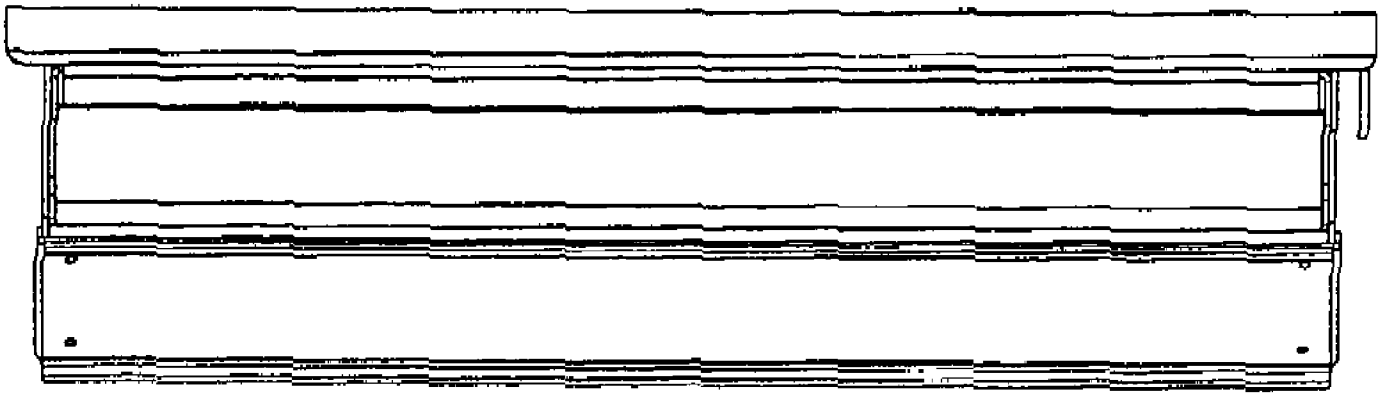
FIG. 10 is a plan view of the alternate embodiment as shown in FIG. 9.
Figure 11:
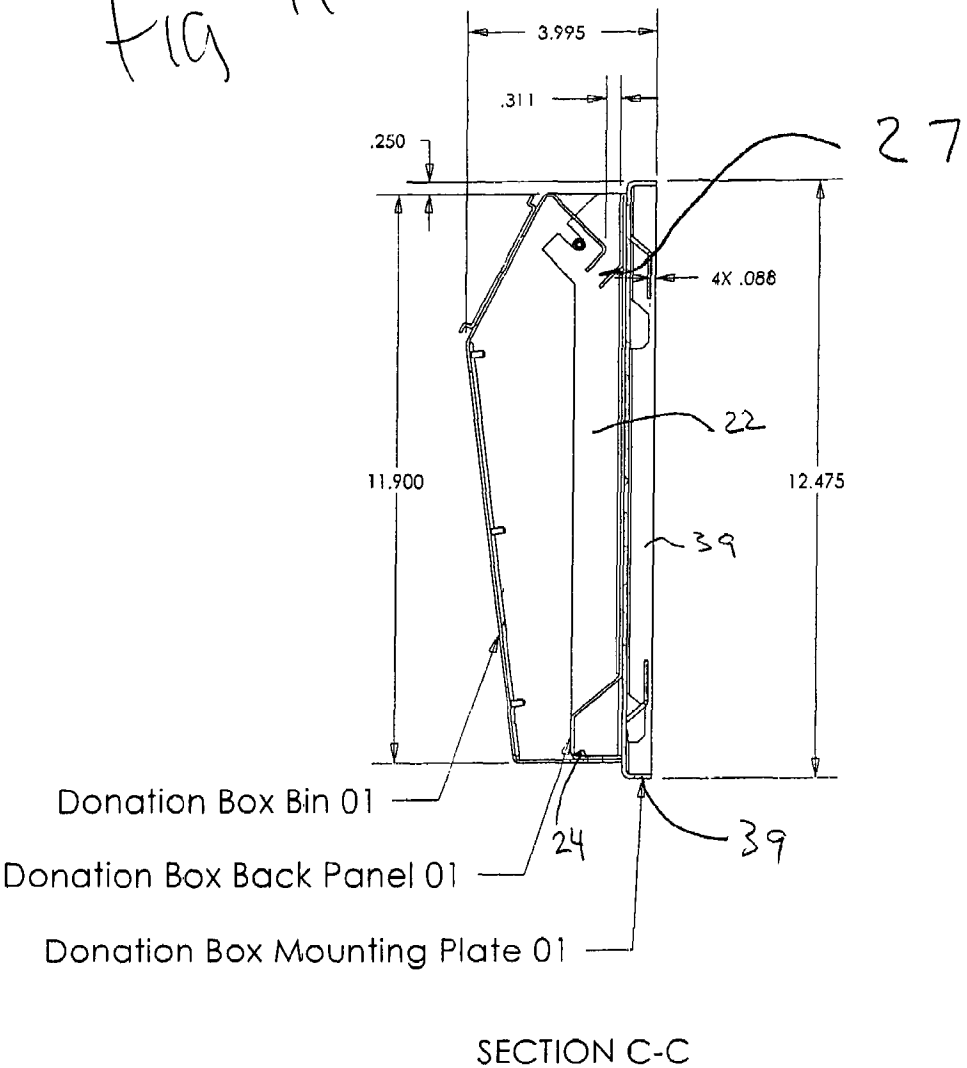
FIG. 11 is a side planar view of the alternate embodiment of FIG. 9.
Figure 12:
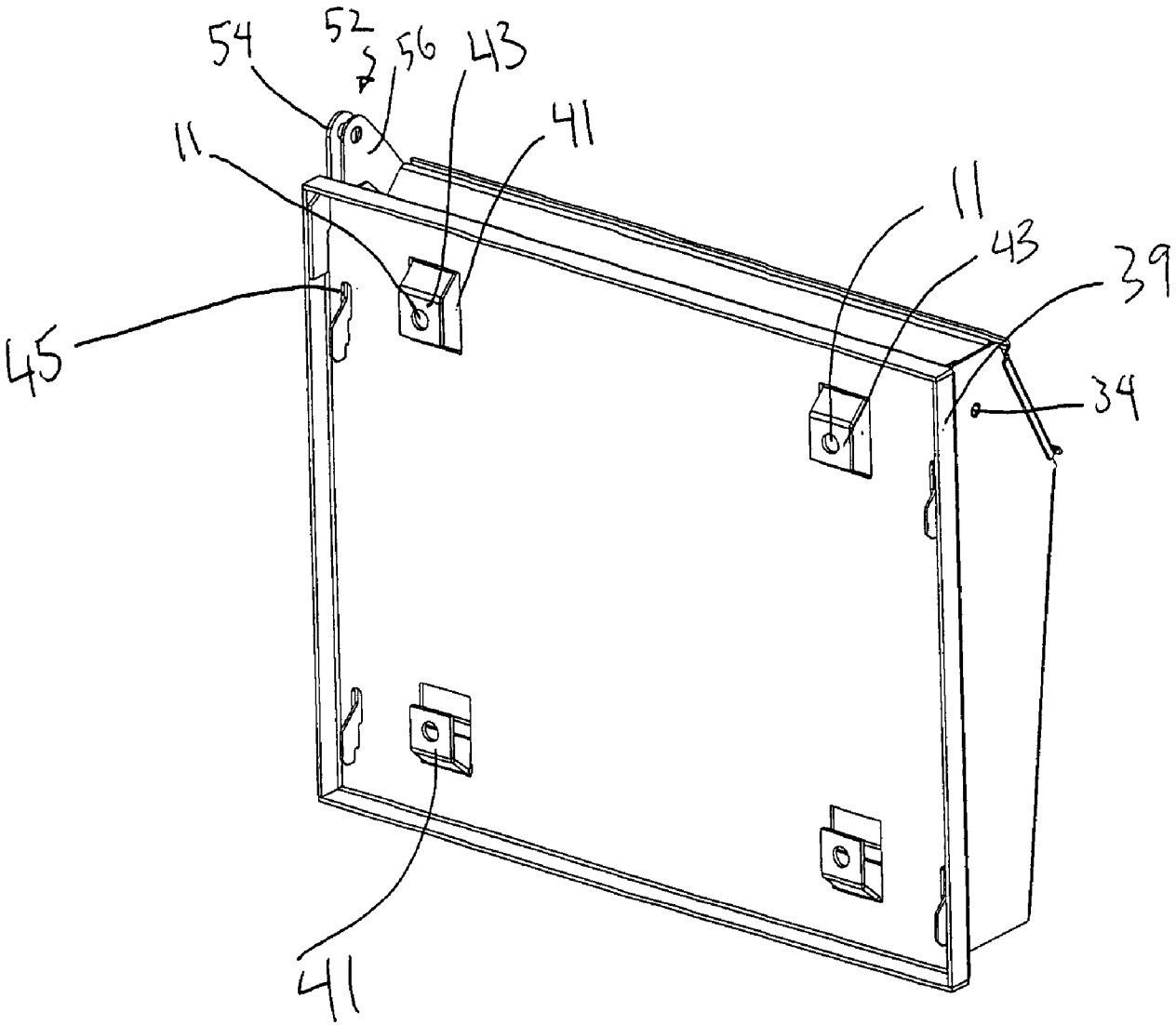
FIG. 12 is a rear perspective view of the alternate embodiment of FIG. 9.
Figure 13:
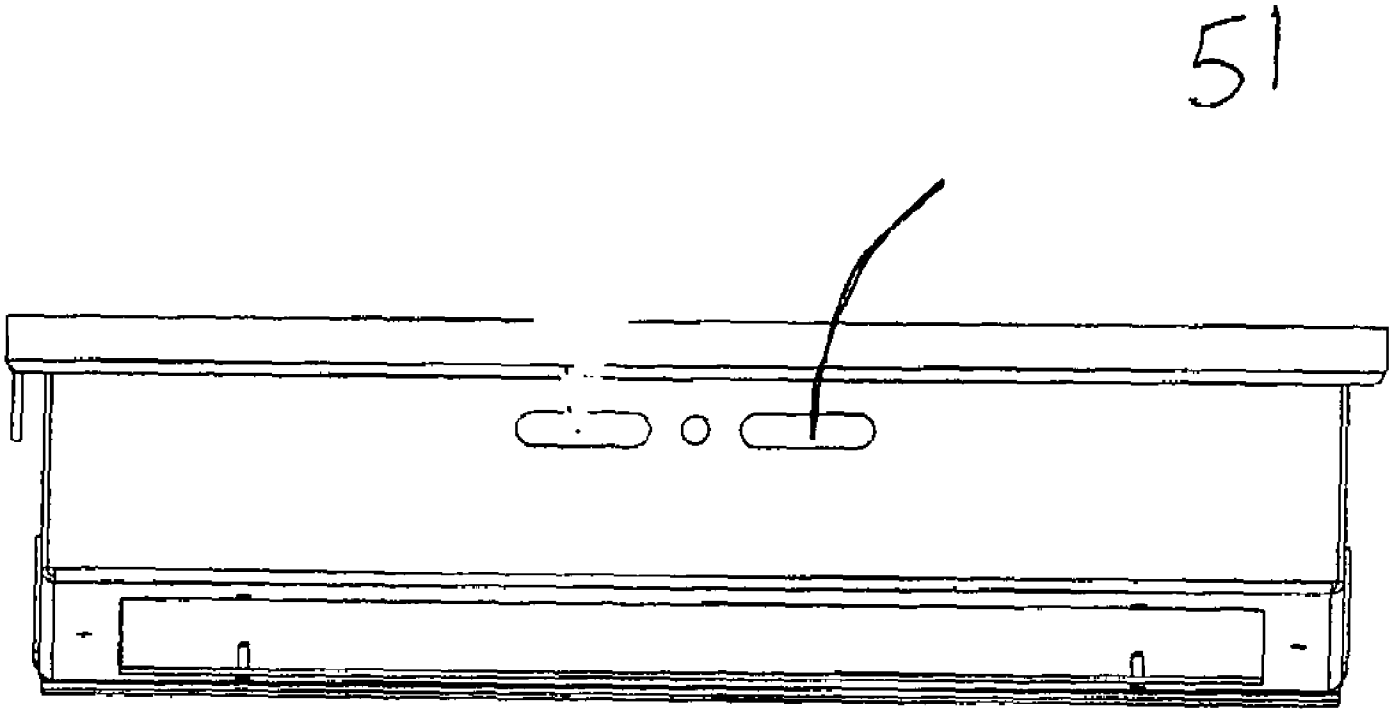
FIG. 13 is a bottom view of the alternate embodiment of FIG. 9.
Figure 11:
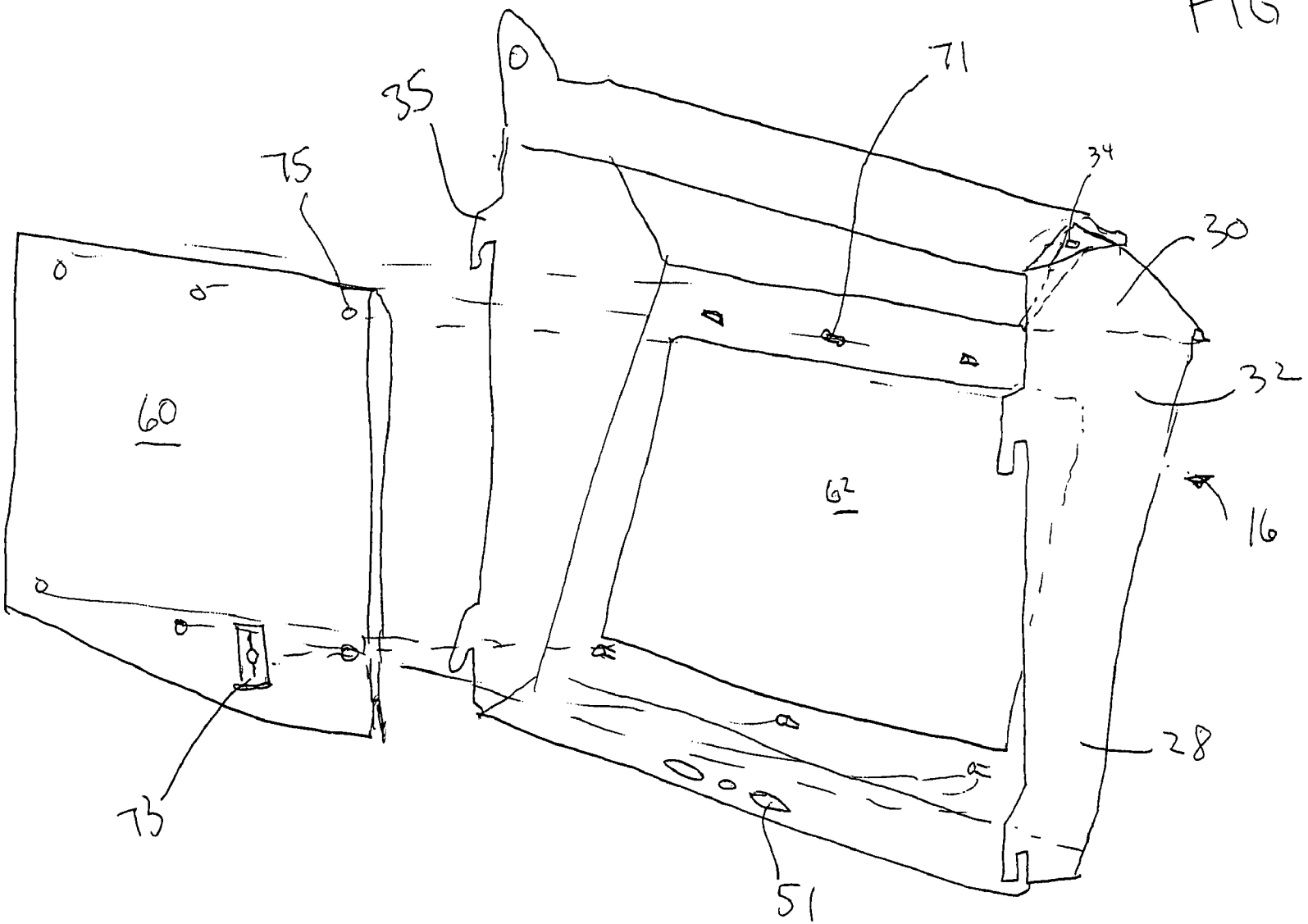
Figure 11:
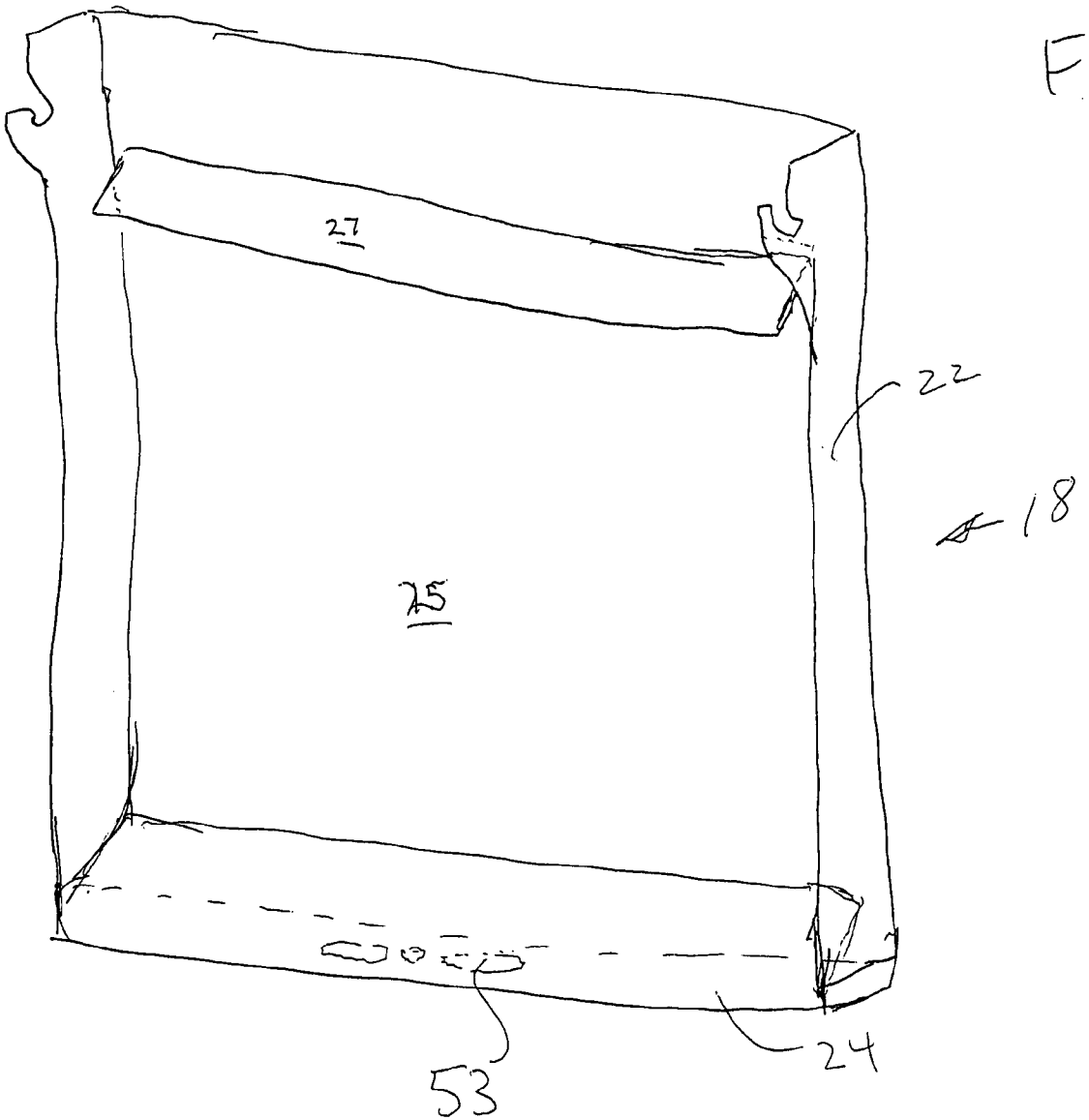
Figure 14:
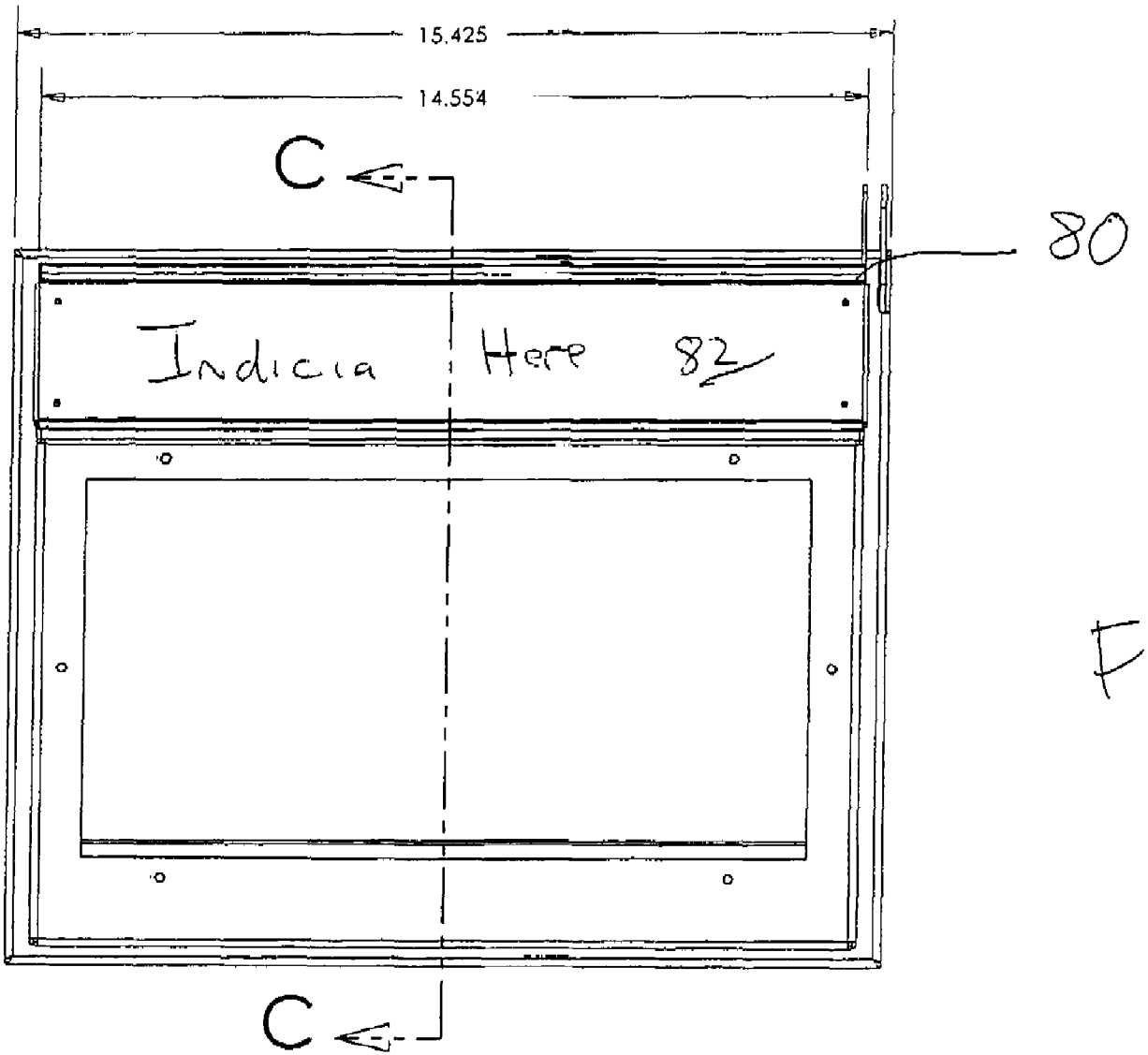
FIG. 14 is an exploded view of the front panel and plate of the alternate embodiment of FIG. 9.

The front panel has a larger lower section 28 and a smaller upper section 30. The upper and lower sections form an obtuse angle. The front panel also has rearwardly extending sides 32. The front panel has pivot pins 34. The pivot pins rotatably couple the tops of the sides of the front panel with the tops of the sides of the rear panel. The front panel has a rectangular shaped window hole 62 there through. When assembled, a money drop opening 33 is provided at the top of and between the front and rear panels for the deposition of charitable contributions. Note FIG. 9. In this manner the front panel is allowed to move forwardly to an open orientation and rearwardly to a closed orientation.

In an alternate configuration, the front panel may also comprise at least one, and preferably four rearwardly and upwardly disposed coupling hooks 35.

A support panel 38 is provided. The support panel is in a rectangular configuration. The support panel has a rear surface. The rear surface is positioned against a recipient surface. The rear surface is adapted to be secured to the recipient surface with bolts place through at least one bolt hole 11. The support panel also has a front surface. The front surface has a canister coupling means, being laterally spaced bars 40. The bars have a T-shaped configuration. The bars extend upwardly from the lower edge of the support panel. The bars are adapted to receive the slots of the canister.

In an alternate configuration the support panel has a rear surface with a rearwardly disposed perpendicular edge 39 around the periphery. In this configuration the rear surface is located proximal to the recipient surface with the perpendicular edge contacting the recipient surface. The support panel has at least one, and preferably four mounting apertures 41 there through, with each mounting aperture having an associated mounting tab 43. The support panel also comprises at least one, and preferably four coupling slots 45. The coupling slots receive and mate with the upwardly disposed coupling hooks of the front panel. Of course, one skilled in the art would recognize that the support panel may have additional apertures there through to reduce the overall weight of the system.

Provided next is a primary locking means 44. The primary locking means includes a tab 46. The tab has an aperture. The aperture extends rearwardly from the front panel adjacent to the lower end. A slit 48 is provided in the indentation of the rear panel. The slit is adapted to slidably receive the tab. In this manner a primary lock may be slid through the aperture of the tab when in the closed orientation and secure the contents of the canister. Also in this manner a primary lock removed from the aperture of the tab allows movement of the front panel to an open orientation for removing the contents from the canister.

In an alternate embodiment the primary locking means may be configured in the form of mating slots. The front panel has a locking slot 51 with a matching slot 53 configuration being also located on the rear panel. In this manner a pad lock, or other such device, may lock the front and rear panels together within the confines of the lock.

A secondary locking means 52 is provided next. The secondary locking means includes a fixed upwardly extending projection 54. The fixed upwardly extending projection has a hole. The fixed upwardly extending projection is secured to one edge of the support panel adjacent to its top edge. The secondary locking means further includes a pivotable upwardly extending projection 56. The pivotable upwardly extending projection has a hole. The pivotable upwardly extending projection is secured to the side of the front panel adjacent to its top edge. In this manner a secondary lock may be slid through the holes when in the closed orientation and secure the canister to the support panel. Also in this manner the secondary lock may be removed from the holes of the tab and allow movement of the canister to another more secure location.

Further provided is a transparent plate 60. The transparent plate is in a rectangular configuration. The transparent plate is larger in both height and width than the rectangular window hole 62. The transparent plate has an plate attachment means for coupling the transparent plate to the front panel. Four recesses 64 are provided in the plate. The four recesses extend rearwardly from the lower portion adjacent to the four corners of the opening. Four notches 66 are provided in the plate. The four notches are provided adjacent to the four corners thereof. The four notches are adapted to overlie the recesses. Four bolts 68 are provided. The four bolts have heads. The bolts are removably received by the recesses and threaded portions extending through the notches. Four wing nuts 70 are provided. The four wing nuts are removably secure the plate to the front panel to facilitate repair and reconstruction.

In an alternate embodiment the plate attachment means comprises the inner surface of the front panel having at least one, and preferably four rearwardly projecting mounting studs 71 with each stud having an associated stud clip 73. The studs are configured to receive and mate with the stud clips. In this embodiment the transparent plate has at least one, and preferably four corner stud holes 75. In this manner the transparent plate may be slipped onto the mounting studs and held in place with the stud clips thereby covering the window hole in the front panel.

Provided last is an indicia assembly 74. The indicia assembly includes upper and lower channels 76, 78. The upper and lower channels are horizontally secured to the upper section of the front panel. The indicia assembly has a transparent generally C-shaped cover 80. The cover is slidable on the channels. The indicia assembly includes an indicia strip 82. The indicia strip is positionable on the upper section between the channels beneath the cover. In this manner the indicia may be changed relating to the charity.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collection canister system comprising:

a horizontally positionable collection canister having a movable front panel being coupled to a rear panel, the rear panel having top and bottom edges and side edges there between, with the front panel having top and bottom edges and side edges there between with an opening adjacent to the top of the front and rear panels for deposition of charitable contributions;

a support panel for coupling the rear panel of the canister to a recipient surface; and at least one locking means to lock the collection canister in a closed orientation so as to facilitate the securement of the contributions within the canister; wherein the rear panel includes mounting means and the support panel having a front surface with a canister coupling means; and wherein the rear panel mounting means comprises laterally disposed slots extending upwardly from the bottom edge with the support panel further having a rectangular configuration with a rear surface positioned against the recipient surface and adapted to be secured thereto with bolts.

2. The system as set forth in claim 1 wherein the canister coupling means comprises laterally spaced bars having a T-shaped configuration extending upwardly from the lower edge of the support panel and configured to receive the slots.

3. The system as set forth in claim 1 wherein the locking means includes a primary locking assembly having a tab with an aperture extending rearwardly from the front panel adjacent to the lower end thereof and a slit in the rear panel adapted to slidably receive the tab whereby a primary lock through the aperture of the tab when in the closed orientation will secure the contents of the canister and whereby the primary lock removed from the aperture of the tab will allow movement of the front panel to an open orientation for removing the contents from the canister.

4. The system as set forth in claim 1 wherein the locking means includes a locking assembly with a fixed upwardly extending projection with a hole secured to one edge of the support panel adjacent to its top edge and a pivotable upwardly extending projection with a hole secured to a side of the front panel adjacent to its top edge whereby a lock through the holes when in the closed orientation will secure the canister to the support panel and whereby the lock removed from the holes of the tab will allow movement of the canister to another more secure location.

5. The system as set forth in claim 1 and further including a transparent plate in a rectangular configuration with a rectangular opening in the front panel of a size smaller than the plate and a plate attachment means.

6. The system as set forth in claim 5 wherein the plate attachment means comprises four recesses extending rearwardly from a lower portion adjacent to the four corners of the opening and four notches in the plate adjacent to the four corners thereof and adapted to overlie the recesses and further including four bolts with heads removably received by the recesses and threaded portions extending through the notches with four wing nuts removably securing the plate to the front panel to facilitate repair and reconstruction.

7. The system as set forth in claim 5 wherein the plate attachment means comprises the transparent plate having at least one stud hole there through, with the front panel having at least one mounting stud and associated stud clip, with the stud hole and stud being mated and held together by the stud clip.

8. The system as set forth in claim 1 and further including an indicia assembly with upper and lower channels horizontally secured to the upper section of the front panel with a transparent generally C-shaped cover slidable on the channels and an indicia strip positionable on the upper section between the channels beneath the cover to allow changing of the indicia relating to the charity.

9. A collection canister system for ensuring the secure and convenient retention of donations to charities comprising, in combination:

a horizontally positionable collection canister having a front panel and a rear panel, the rear panel having horizontal top and bottom edges and vertical side edges there between and laterally displaced linear slots extending upwardly from the bottom edge parallel with the side edges, the rear panel also having forwardly extending sides and a forwardly extending bottom with an indentation adjacent to the bottom edge in a central extent, the front panel having a larger lower section and a smaller upper section, the upper and lower sections forming an obtuse angle, the front panel also having rearwardly extending sides with pivot pins rotatably coupling the tops of the sides of the front panel with the tops of the sides of the rear panel with an opening at the top of the front and rear panels for deposition of charitable contributions, thereby allowing the front panel to move forwardly to an open orientation and rearwardly to a closed orientation;

a support panel in a rectangular configuration with a rear surface positioned against a recipient surface and adapted to be secured thereto with bolts, the support panel also having a front surface with laterally spaced bars having a T-shaped configuration extending upwardly from the lower edge of the support panel and adapted to receive the slots of the canister;

a primary locking assembly including a tab with an aperture extending rearwardly from the front panel adjacent to the lower end thereof and a slit in indentation of the rear panel adapted to slidably receive the tab whereby a primary lock through the aperture of the tab when in the closed orientation will secure the contents of the canister and whereby the primary lock removed from the aperture of the tab will allow movement of the front panel to an open orientation for removing the contents from the canister;

a secondary locking assembly including a fixed upwardly extending projection with a hole secured to one edge of the support panel adjacent to its top edge and a pivotable upwardly extending projection with a hole secured to side of the front panel adjacent to its top edge whereby a secondary lock through the holes when in the closed orientation will secure the canister to the support panel and whereby the secondary lock removed from the holes of the tab will allow movement of the canister to another more secure location;

a transparent plate in a rectangular configuration with a rectangular opening in the lower portion of the front panel of a size smaller than the plate, four recesses extending rearwardly from the lower portion adjacent to the four corners of the opening and four notches in the plate adjacent to the four corners thereof and adapted to overlie the recesses and further including four bolts with heads removably received by the recesses and threaded portions extending through the notches with four wing nuts removably securing the plate to the front panel to facilitate repair and reconstruction; and an indicia assembly including upper and lower channels horizontally secured to the upper section of the front panel with a transparent generally C-shaped cover slidable on the channels and an indicia strip positionable on the upper section between the channels beneath the cover to allow changing of the indicia relating to the charity.

10. A collection canister system for ensuring the secure and convenient retention of donations to charities comprising, in combination:

a horizontally positionable collection canister having a front panel and a rear panel, the rear panel having horizontal top and bottom edges and vertical side edges there between, the rear panel also having forwardly extending sides and a forwardly extending bottom, the rear panel also having a drop deflector located adjacent the top of the panel, the front panel having a larger lower section and a smaller upper section, the upper and lower sections forming an obtuse angle, the front panel also having rearwardly extending sides with pivot pins rotatably coupling the tops of the sides of the front panel with the tops of the sides of the rear panel with an opening at the top of the front and rear panels for deposition of charitable contributions, thereby allowing the front panel to move forwardly to an open orientation and rearwardly to a closed orientation with the lower edge of the front panel having a primary locking means;

a support panel in a rectangular configuration with a rear surface positioned adjacent a recipient surface, the support panel having rearwardly disposed side and top and bottom edges that contact a recipient surface, with the support panel having at least one mounting hole with the mounting hole having an associated mounting tab;

the primary locking means comprising at least one aperture through the lower edge of the front panel and an matching aperture through the lower edge of the rear panel whereby a lock will securely couple the front and rear panels together and secure the contents of the canister and whereby the lock being removed from the aperture will allow movement of the front panel to an open orientation for removing the contents from the canister;

a secondary locking means comprising the support panel having a fixed upwardly extending projection with a hole secured to one edge of the support panel adjacent to its top edge and an upwardly extending projection with a hole secured to a side of the front panel adjacent to its top edge whereby a secondary lock is passed through the holes when the canister and the support panel are in the closed orientation and the secondary lock will secure the canister to the support panel and whereby the secondary lock removed from the holes of the tab will allow movement of the canister to another more secure location;

a transparent plate in a rectangular configuration with the plate having at least one bolt hole there through;

a plate attachment means comprising the inner surface of the front panel having at least one rearwardly projecting mounting stud with the stud having an associated stud clip, the clip being configured to receive and mate with the stud clip, with the transparent plate having at least one corner stud hole; and an indicia assembly including upper and lower channels horizontally secured to the upper section of the front panel with a transparent generally C-shaped cover slidable on the channels and an indicia strip positionable on the upper section between the channels beneath the cover to allow changing of the indicia relating to the charity.

* * * * *